United States Patent [19]

Fish et al.

[11] Patent Number: 4,663,953

[45] Date of Patent: May 12, 1987

[54] LOCK MECHANISM

[75] Inventors: Aaron M. Fish, Rocky Mount, N.C.; Hariharan Somasundaram, Montreal, Canada

[73] Assignee: Ilco-Unican Corp., Rocky Mount, N.C.

[21] Appl. No.: 882,149

[22] Filed: Jul. 3, 1986

Related U.S. Application Data

[63] Continuation-in-part of Ser. No. 650,420, Sep. 14, 1984, abandoned.

[51] Int. Cl.[4] ..... E05B 17/04

[52] U.S. Cl. ..... 70/380; 70/216

[58] Field of Search ..... 70/216, 224, 374, 379 R, 70/379 A, 380, DIG. 67; 292/336.5, 352

[56] References Cited

U.S. PATENT DOCUMENTS

| | | | |
|---|---|---|---|
| 1,883,119 | 10/1932 | Tomoray | 70/216 |
| 2,008,662 | 7/1935 | Bechert | 70/224 |
| 2,948,140 | 8/1960 | Etsten | 70/216 |
| 3,955,387 | 5/1976 | Best | 292/352 |
| 4,228,669 | 10/1980 | Bichoff | 70/379 R |
| 4,328,690 | 5/1982 | Oliver | 70/380 |
| 4,427,852 | 1/1984 | Wolniak | 200/44 |

FOREIGN PATENT DOCUMENTS

| | | | |
|---|---|---|---|
| 696518 | 10/1964 | Canada | 70/379 R |

*Primary Examiner*—Robert L. Wolfe

*Attorney, Agent, or Firm*—Ira Milton Jones

[57] ABSTRACT

A lock mechanism incorporating a coupling device through which rotation of a lock plug is transmitted to a bolt actuating shift, and which readily allows for interchangeability of key removable locking cores of different axial lengths in a door knob in any of a plurality of different positions of rotation of the lock plug.

2 Claims, 2 Drawing Figures

LOCK MECHANISM

Figure 1:
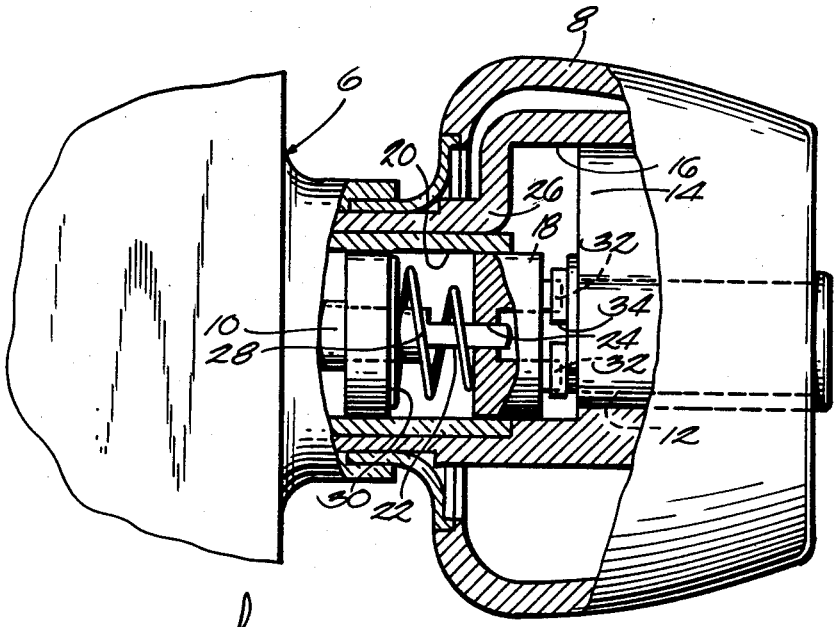

This invention relates to lock mechanisms of the type having a core containing a rotatable lock plug, and wherein rotation of the plug (by a suitable key) to an unlocking position is translated into retracting motion of a lock bolt through a bolt actuating shaft operatively connected with the plug.

In a more specific sense, this invention has reference to locking devices for doors having a knob with a cavity therein to interchangeably receive lock cores of different lengths.

Heretofore, it has been customary to provide for transmission of rotation from the plug to the bolt actuating shaft of lock mechanisms of the character described by means of a coupling device situated between and operatively connected with the rear of the plug and the adjacent forward end of the shaft through two elongated torque pins on the coupling device, extending forwardly into diametrically opposite holes in the rear portion of the plug.

This arrangement has presented an annoying problem in lock mechanisms which were adapted for reception of removable cores of different axial lengths. In such mechanisms it was frequently necessary to provide a torque coupler of appropriate length, whenever the variation in core length was due to difference in the numbers of pins in the tumbler or a difference in make of the core. Accordingly, this problem resulted in the necessity for providing different locks for cores of different lengths even though the core profile remained the same, and also required precise rotational alignment of the couplers connecting their plugs to the bolt actuating shafts to enable proper insertion of the cores into the door knob and securement of the same therein.

The primary purpose of this invention is to eliminate the necessity for providing different locks for cores of different lengths through the provision of a spring loaded torque coupler capable of sliding axially along the bolt actuating shaft to whatever position is necessary to accommodate the length of the core inserted into the knob.

It is another purpose of this invention to provide a lock mechanism of the character described having coupling means to rotatably connect the bolt actuating shaft with the lock plug in any of a plurality of different positions of rotation of the plug, regardless of the length of the core in which the plug is mounted.

In this last respect, it is an object of the invention to provide coupling means which is rendered operative merely by slight rotation of the lock plug following securement of the core in the door knob.

With these and other objects in view, the manner in which the invention achieves its purpose will be appreciated from the following description and the accompanying drawing, which exemplifies the invention, it being understood that changes may be made in the specific apparatus disclosed herein without departing from the essentials of the invention set forth in the appended claims.

Figure 2:
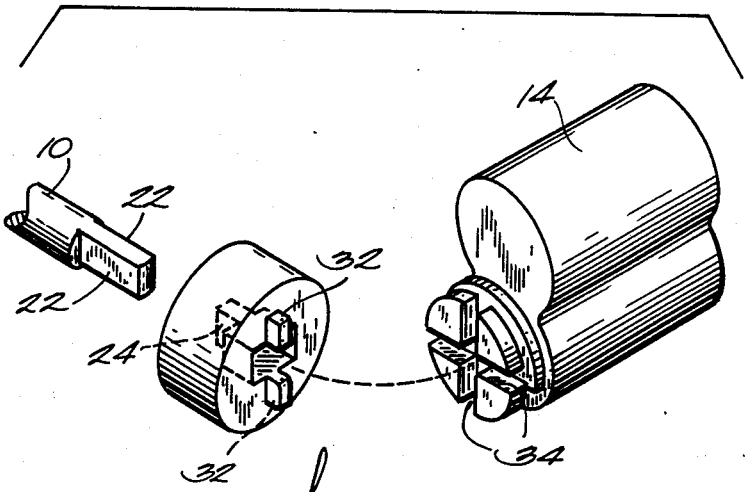

The accompanying drawing illustrates one complete example of the embodiment of the invention constructed according to the best mode so far devised for the practical application of the principles thereof, and in which:

FIG. 1 is a view of the lock mechanism of this invention, showing the components thereof partly in section and partly in elevation; and FIG. 2 is a perspective of the lock core and the torque coupler showing these components removed from the door knob and separated to better illustrate the torque transmitting connection therebetween.

Referring now to the accompanying drawings, the numeral 6 generally designates that portion of a door that has the door knob 8 mounted thereon. As is customary, rotation of the knob is imparted to a bolt retracting shaft 10 to release the bolt (not shown) and allow for opening of the door, provided of course that the lock plug 12 has been rotated to an unlocked position by means of a suitable key (not shown). As is customary, the plug is rotatably mounted in a core 14 to form a part thereof.

The core 14 is received and removably secured in a forwardly opening cavity 16 in the knob 8, and it has herein been shown by way of example as having an axial length somewhat less than the depth of the cavity. Hence, it is possible for cores of greater length to be accommodated in the cavity. Core length, of course, will increase with increase in the number of tumblers (not shown) provided in the plug, but the core should be secured in the knob with its front face substantially flush with the front of the knob.

Rotation of the plug 12 to an unlocked position is transmitted to the bolt actuating shaft 10, for release of a lock bolt connected therewith, through a special cylindrical torque coupler 18 at the rear of the plug. The coupler is rotatably received in a bore 20 in the knob smaller in diameter than its cavity 16 and extending inwardly therefrom, and the coupler is mounted on the forward end portion of the bolt actuating shaft 10.

The forward end portion of the shaft has diametrically opposite flatted sides 22 thereon which are parallel to one another and which project through an axial hole 24 in the center of the coupler 18. The hole 24 has opposite side walls that are flat and are slidingly engaged with the flatted sides of the shaft to thus provide a splined driving connection between the shaft and coupler.

This spline connection between the shaft and coupler allows the latter to slide axially along the flatted forward end portion of the shaft a distance at least equal to the space between the inner end of the core 14 and the bottom 26 of the cavity in the door knob. Thus, a core of greater axial length than that shown can be accommodated in the cavity while still providing for connection of its plug to the shaft 10 through the torque coupler 18.

A coiled spring 28 encircling the flatted portion of the shaft is confined between a spring stop 30 on the shaft and the rear face of the coupler to at all times yieldingly urge the latter toward engagement with the rear end of the plug 12. This spring also maintains a torque transmitting connection between the plug and coupler in an operative condition.

The splined connection just described, along with the novel torque transmitting connection now about to be described, are the main features of this invention.

Torque is transmitted from the lock plug 12 to the coupler 18 through what can be termed a tongue and groove connection maintained operative by the spring 28, with the tongue on one of said components and the groove on the other. As herein shown, the coupler 18 is provided with the tongue, consisting of diametrically opposite lugs 32 at opposite sides of the hole 24, while the rear of the plug is provided with the groove.

Actually, for purposes of this invention, there are two crossing grooves or slots 34 formed in the rear of the plug, at right angles to one another, so as to achieve the advantage of enabling the torque transmitting connection between the coupler and plug to be established in two different positions of rotation of the plug relative to the coupler.

In this way, it is not only possible for the torque transmitting connection to accommodate cores of different lengths, due to the spline connection between the coupler and shaft 10, but it also eliminates the necessity of aligning the coupling and core assembly before the core is inserted into the knob. The core, and more particularly the plug therein, is automatically drivingly connected to the coupler as soon as the key (not shown) is inserted into the plug to rotate the same in the direction to retract the latch bolt.

From the foregoing description together with the accompanying drawings, it will be readily apparent to those skilled in the art that this invention eliminates the need for supplying different locks for cores of different lengths but of the same general configuration, and thus achieves the advantage of reducing the inventory of locks down to that which is necessary to accommodate a wide range of cores.

Those skilled in the art will appreciate that the invention can be embodied in forms other than as herein described for purposes of illustration.

We claim:

1. In a lock mechanism of the type having a rotatable plug member with front and rear ends, and a bolt actuating shaft coaxial with the plug member and having a forward end portion adjacent to the rear of the latter, means for transmitting rotation of the plug member to the bolt actuating shaft, characterized by:

A. said forward portion of the actuating shaft having opposite flatted sides that are parallel to one another along an elongated portion of the shaft;

B. an annular coupling member seated on said elongated portion of the shaft and having an axial hole therethrough, opposite side walls of which are flat and slidingly engaged with said flatted sides of the shaft to constrain the shaft to rotate with the coupling member while allowing the latter to slide axially along said elongated portion of the shaft;

C. means to yieldingly urge the coupling member against the rear of the plug member, comprising a coiled spring encircling said flatted portion of the shaft and bearing against the coupling member;

D. and means maintained operative by said spring for connecting said plug and coupling members for rotation in unison, comprising a pair of diametrically opposite lugs on one of said last named members, and crossing diametrical slots on the other of said last named members in which said lugs can be held engaged by said spring in either of two positions of relative rotation of said plug and coupling members placed 90° apart.

2. The rotation transmitting means of claim 1, wherein said slots are in the rear of the plug, and said lugs are on the front of the coupling member at opposite sides of the hole therein.

* * * * *